US011383293B2

(12) United States Patent
Jin et al.

(10) Patent No.: US 11,383,293 B2
(45) Date of Patent: Jul. 12, 2022

(54) DOUBLE STATION VACUUM DIE CASTING MACHINE

(71) Applicant: Yanshan University, Qinhuangdao (CN)

(72) Inventors: Xin Jin, Qinhuangdao (CN); Xueqian Yu, Qinhuangdao (CN); Wang Zhan, Qinhuangdao (CN); Tingzhi Ren, Qinhuangdao (CN); Yuanzhe Jin, Qinhuangdao (CN)

(73) Assignee: Yanshan University, Qinhuangdao (CN)

( * ) Notice: Subject to any disclaimer, the term of this patent is extended or adjusted under 35 U.S.C. 154(b) by 0 days.

(21) Appl. No.: 17/238,270

(22) Filed: Apr. 23, 2021

(65) Prior Publication Data

US 2021/0331234 A1 Oct. 28, 2021

(30) Foreign Application Priority Data

Apr. 24, 2020 (CN) ..... 202010334238.3

(51) Int. Cl.

| | |
|---|---|
| ***B22D 17/14*** | (2006.01) |
| ***B22D 17/04*** | (2006.01) |
| ***B22D 17/20*** | (2006.01) |
| ***B22D 17/22*** | (2006.01) |
| ***B22D 17/32*** | (2006.01) |

(52) U.S. Cl.

CPC ..... *B22D 17/14* (2013.01); *B22D 17/04* (2013.01); *B22D 17/2023* (2013.01); *B22D 17/22* (2013.01); *B22D 17/32* (2013.01)

(58) Field of Classification Search

CPC ..... B22D 17/04; B22D 17/14; B22D 17/20; B22D 17/2015; B22D 17/22; B22D 17/32; B22D 17/2023

USPC ..... 164/253, 254, 256, 303, 312, 113

See application file for complete search history.

(56) References Cited

U.S. PATENT DOCUMENTS

2011/0094702 A1* 4/2011 Taniguchi ..... B22D 17/2015 164/312

* cited by examiner

*Primary Examiner* — Kevin P Kerns

(74) *Attorney, Agent, or Firm* — IPro, PLLC

(57) ABSTRACT

The invention provides a double station vacuum die casting machine, comprising a driving device, a first die casting unit, a second die casting unit, a feeding component, a vacuum pump and a housing, the vacuum pump is arranged outside the housing, the driving device is arranged inside the housing, and the first die casting unit and the second die casting unit are respectively arranged on both sides of the driving device; the driving device comprises a driving unit, a first injection rod assembly and a second injection rod assembly, the first injection rod assembly and the second injection rod assembly are respectively arranged on both sides of the driving unit, the first injection rod assembly is used to provide power for die casting of the first die casting unit, and the second injection rod assembly is used to provide power for the second die casting unit.

5 Claims, 8 Drawing Sheets

DOUBLE STATION VACUUM DIE CASTING MACHINE

TECHNICAL FIELD

The present disclosure relates to the technical field of precision part forming, in particular to a double station vacuum die casting machine.

BACKGROUND

Die casting is a casting process in which molten metal in a high-temperature molten state is injected into a mold cavity at high pressure and high speed, and then is cooled and solidified under pressure to obtain a casting part. The characteristic of this casting method is that the product is precisely formed and the production efficiency is high. However, the conventional die casting process has defects, because the gas in the mold cavity cannot be effectively removed during high-speed injection, it remains inside the casting part and forms pore defect, which leads to the deterioration of the mechanical property of the casting part. In order to solve this problem, people use a vacuum method, that is, the gas in the cavity is extracted during die casting to form a certain vacuum or negative pressure state, thereby the pore defect inside the casting part is reduced.

For a long time, in order to broaden the application range of die castings and improve the mechanical property of die casting, some new die casting methods have been researched, such as laminar filling method (ultra-low speed die casting method), oxygen filling die casting method and vacuum die casting method. The main purposes of the above methods are to reduce the entrainment phenomenon during the filling process of the molten metal, so as to improve the mechanical property of the casting part. Because the laminar filling method has low production efficiency, and the oxygen-filled die casting method has the disadvantages of complicated operating procedures and difficultly controlled process parameters, both methods are not widely used in actual production. However, in the vacuum die casting method, the gas in the cavity is extracted and the molten metal is filled in the cavity in a vacuum state, so that less gas is involved and the mechanical property of the casting are improved. In addition, vacuum die casting is the same as ordinary die casting method, it is easy to operate and does not reduce production efficiency. Therefore, the vacuum die casting method has shown strong vitality since its appearance. With the development of related technologies, its application will become more and more extensive. Especially in the preparation of amorphous alloys, being a new type of material with very high strength, hardness and corrosion resistance, amorphous alloys show obvious advantages in impact fracture performance. Amorphous alloys have very low elastic modulus but store a lot of elastic energy, and have a very good energy delivery performance. Since bulk amorphous alloys have obvious glass transition, very high supercooled liquid stability and de-crystallization thermal stability, machining it at room temperature is extremely difficult, which limits the application range of amorphous alloys. In recent years, using vacuum die casting to prepare amorphous alloy parts has become the first choice.

However, sealing is extremely important for vacuum die casting. The tightness of the mold is directly related to its material. A mold with good tightness has high material requirement and is expensive. Existing vacuum die casting machines are mostly sealed with rubber rings and bellows.

However, due to the friction of the injection rod punch against the rubber ring during die casting, the rubber ring is prone to fatigue damage and needs to be replaced frequently. The replacement of the rubber ring is cumbersome, which seriously reduces the working efficiency of the vacuum die casting machine. The vibration of the die casting machine during die casting makes the seal of the bellows leak. In addition, the vacuum chamber needs to be vacuumed for each die casting process, which greatly reduces the working efficiency of the die casting machine. This die casting machine has good sealing performance and does not need to be vacuumed every time. The traditional vacuum die casting machine needs the injection punch to hold the pressure after the molten metal is injected into the mold, and the pressure punch is required to apply force during the mold opening process to stop the injection punch at the molten metal outflow port to maintain the vacuum of the working chamber. The patent seeks a method not only to realize the pressure holding process and maintain the vacuum of the working chamber, but also to continue the vacuum die casting work.

SUMMARY

In view of the mentioned above urgent problem of vacuum die casting machine, the present invention provides a double station vacuum die casting machine, mainly by rotating the relative position of the pressure chamber, to solve the problem of the existing vacuum die casting machine, which requires the pressure injection rod to apply force when the mold is opened so that the vacuum of the vacuum chamber is maintained and the die casting is stopped. Furthermore, a two-way linear drive is provided based on electromagnetics, which solves the problems of long vacuum chamber vacuuming time, large driving device size and easy aging of the sealing device, realizes double station work and improves the quality and efficiency of amorphous alloy preparation.

The present invention provides a double station vacuum die casting machine, which comprises a driving device, a first die casting unit, a second die casting unit, a feeding component, a vacuum pump, and a housing. The vacuum pump is arranged outside the housing. The driving device is arranged inside the housing, and the first die casting unit and the second die casting unit are respectively arranged on both sides of the driving device.

The driving device comprises a driving unit, a first injection rod assembly and a second injection rod assembly. The first injection rod assembly and the second injection rod assembly are respectively arranged on both sides of the driving unit. The first injection rod assembly is used to provide power for die casting of the first die casting unit, and the second injection rod assembly is used to provide power for the second die casting unit;

The driving unit comprises a stator assembly and a mover assembly. The mover assembly is arranged inside the stator assembly. The stator assembly comprises a drive base, a stator iron core, a stator winding, and a stator iron core winding groove. The stator iron core is installed inside the drive base, the drive base is installed in the middle of the bottom surface of the housing, the stator iron core winding groove is arranged inside the stator iron core, and the stator winding is installed inside the stator iron core winding groove; the mover assembly comprises a mover permanent magnet and a mover sleeve, the mover permanent magnets are evenly distributed on the mover sleeve; the first injection rod assembly and the second injection rod assembly are symmetrically arranged, the first end of the mover sleeve is connected to the first injection rod assembly, and the second end of the mover sleeve is connected to the second injection rod assembly;

The first die casting unit and the second die casting unit are symmetrically arranged and have the same structure. Both of the first die casting unit and the second die casting unit include a rotating device, a fixed mold assembly, a moving mold assembly, and a sliding rod;

The fixed mold assembly comprises a fixed mold, a fixed mold plate, a pressure chamber, and a pressure chamber sleeve. The first end of the fixed mold is provided with a molten metal pouring port, a cross runner, a fixed mold insert block, a molten metal remnant pouring port, a molten metal remnant cross runner, a remnant fixed mold insert block, a constant pressure passage connection port and a constant pressure passage, the fixed mold insert block is connected to the first end of the cross runner, and the second end of the cross runner is provided with a molten metal pouring port, the remnant fixed mold insert block is connected to the first end of the molten metal remnant cross runner, the second end of the molten metal remnant cross runner is provided with a molten metal remnant pouring port, the constant pressure passage connection port is connected to the constant pressure passage, the first end of the fixed mold plate is connected to the first end of the fixed mold, the inner corner of the fixed mold plate is connected to the sliding rod, the second end of the fixed mold plate is connected to the first end of the housing, and the pressure chamber is connected to the rotating device;

The moving mold assembly comprises a moving mold, a moving mold plate, an ejection cylinder, a sliding rod through hole, a moving mold insert block and a molten metal remnant moving mold insert block. The first end of the moving mold plate is connected to the second end of the moving mold. The first end of the moving mold is connected to the second end of the fixed mold. The second end of the moving mold is provided with a moving mold insert block and a molten metal remnant moving mold insert block. The second end of the moving mold plate is connected to the ejection cylinder, and the inner corner of the moving mold plate is connected to a sliding rod;

The pressure chamber is located inside the fixed mold plate, the fixed mold and the housing. The pressure chamber sleeve is arranged outside the first end of the pressure chamber. The first end of the pressure chamber is connected to the second end of the moving mold by means of the pressure chamber sleeve, and one end of the injection rod assembly extends into the second end of the pressure chamber;

The pressure chamber is provided with a molten metal supply port and a molten metal outflow port, the molten metal outflow port is located at the upper part of the first end of the pressure chamber, the molten metal supply port is located at the upper part of the second end of the pressure chamber. The pressure chamber sleeve is provided with a sleeve molten metal pouring port, a sleeve molten metal remnant pouring port and a sleeve constant pressure passage connection port, the sleeve molten metal pouring port is connected to the molten metal pouring port. The sleeve molten metal remnant pouring port is connected to the molten metal remnant pouring port, and the sleeve constant pressure connection port is connected to the constant pressure passage connection port;

The pressure chamber has three positions relative to the pressure chamber sleeve by means of the rotation of the rotating device:

A first position: the pressure chamber molten metal outflow port is opposite to the sleeve molten metal pouring port;

A second position: the pressure chamber molten metal outflow port is opposite to the sleeve molten metal remnant pouring port;

A third position: The pressure chamber molten metal outflow port is opposite to the constant pressure passage connection port.

Preferably, the stator iron core winding grooves are evenly arranged in the stator iron core in an annular shape, stator teeth are formed between the stator iron core winding grooves, the mover permanent magnets are in annular shape. The magnetic poles of two adjacent mover permanent magnets are opposite, and the thickness of the magnetic pole of the mover permanent magnets is the same as the width of the stator teeth;

The mover sleeve is in the shape of a hollow cylinder, the outer surface of the mover sleeve is covered with a good conductive magnet to form a mover yoke, and the inner surface of the mover sleeve is provided with internal threads connecting to the threads of the injection rod, the gap between the mover assembly and the stator assembly forms an air gap;

The drive base is provided with a drive device installation through hole for installing the stator iron core, and the first end and the second end of the drive device installation through hole are respectively provided with heat-insulating end covers.

Preferably, the feeding component comprises an electric heating crucible, a supporting rod and a feeding door. The second end of the fixed mold plate of the first die casting unit is connected to the first end of the housing. The first end of the fixed mold plate of the second die casting unit is connected to the second end of the housing. The feeding door is located at the upper part of the housing, the first end of the supporting rod is connected to the side of the electric heating crucible through a rotating pair, the electric heating crucible is located at the lower end of the feeding door, the second end of the supporting rod is fixedly connected to the housing at the feeding door; the vacuum pump is located at the upper end of the fixed mold plate of one of the die casting units.

Preferably, the rotating device comprises a rotating device stator assembly and a rotating device rotor assembly. The rotating device rotor assembly is provided inside the rotating device stator assembly. The rotating device stator assembly comprises a rotating device stator iron core and a rotating device stator winding connected to each other. The rotating device rotor assembly comprises a rotating device permanent magnet and a rotating device rotor sleeve, and the rotating device permanent magnets are evenly arranged in the circumferential direction of the rotating device rotor sleeve.

Preferably, the second end of the moving mold is provided with a pressure chamber sleeve mating groove that is mated with the pressure chamber sleeve, and the four inner corners of the moving mold plate are provided with sliding rod through holes for connecting the sliding rod;

The second end of the fixed mold plate is provided with a rotating device installation groove, the rotating device stator iron core is installed in the rotating device installation groove of the second end of the fixed mold plate, and the four inner corners of the first end of the moving mold plate are respectively provided with mold clamping mechanism connection holes.

Preferably, both of the first injection rod assembly and the second injection rod assembly include an injection rod and an injection punch, and the first end of the injection rod is connected to the injection punch.

Preferably, the part of the pressure chamber located in the fixed mold plate and the fixed mold is provided with a heating device. The size and shape of the molten metal outflow port are the same as that of the sleeve molten metal pouring port, the sleeve molten metal remnant outflow port and the sleeve constant pressure passage connecting port. The sleeve molten metal pouring port is located at the upper part of the first end of the pressure chamber sleeve. The sleeve molten metal remnant outflow port, the sleeve constant pressure passage connection ports and the sleeve molten metal pouring ports are located on the same circumferential line and are arranged at an interval of 45° in sequence. The constant pressure passage connection port has a certain depth, and the constant pressure passage connection port on the fixed mold connects to the passage through the fixed mold and the fixed mold plate communicating with the vacuum chamber of the vacuum pump.

Preferably, the inner surface of the rotating device installation groove is circumferentially arranged with a convex structure, and the convex structure has the same shape as the groove structure on the rotating device stator iron core. The rotating device stator iron core is in the shape of hollow cylinder, and arranges at an interval of 30° iron core wound with the rotating device stator winding. The rotating device stator winding is wound and connected to a three-phase sinusoidal alternating current according to the working principle of an asynchronous motor. The rotating device rotor sleeve is in the shape of hollow cylinder. The inner surface of the rotating device rotor sleeve is provided with a circumferential tooth-like structure, which has the same shape as the circumferential tooth-like structure of the outer surface of the connecting part of the pressure chamber for mating connection.

Preferably, the axes of the pressure chamber of the first die casting unit and the second die casting unit, the injection assembly, the pressure chamber sleeve, the stator iron core, the heat-insulating end cover, the mover permanent magnet and the mover sleeve, the rotating device stator iron core and the rotating device rotor sleeve are on the same straight line. The extreme position of the injection punch movement is connected to the inside of the second end of the pressure chamber. The axes of the fixed mold plate, the fixed mold, the moving mold and the sealing ring are on the same straight line. The inner diameter of the pressure chamber is equal to the diameter of the injection punch, and both of the inner diameter of the pressure chamber and the diameter of the injection punch are larger than the diameter of the injection rod.

Preferably, the outer shape of the seal ring is a rectangular frame, the outer frame of the seal ring is smaller than the connecting surface of the fixed mold and the moving mold. The connecting surface of the fixed mold and the moving mold is smaller than that of the fixed mold plate and the moving mold plate. The fixed mold and the moving mold are provided with sealing ring grooves. The width of the sealing ring groove is smaller than the thickness of the sealing ring.

Compared with the prior art, the present invention has the following beneficial effects:

1. Compared with the traditional vacuum die casting machine, the present invention does not need to use the injection rod to drive the injection punch to hold the pressure against the die casting part during die casting and to maintain the vacuum in the working chamber when the mold is opened. The driving device makes the mover sleeve move in the reverse direction to drive the injection rod assembly to perform the same die casting work in the other direction, which can greatly improve the efficiency of die casting.

2. The vacuum die casting machine of the present invention uses electromagnetic thrust to provide the injection power of the injection rod, which solves the problem of poor vacuum sealing caused by the wear of the bellows in the original vacuum die casting machine, and can better prevent crystallization of the molten amorphous alloy so as to save production raw materials.

3. The present invention uses electromagnetic thrust to achieve two-way linear drive and rotation of the pressure chamber, which can change the size and frequency of the current to control the size and injection speed of the electromagnetic thrust applied by the injection punch. By controlling the time of passing the current, the rotation angle of the pressure chamber can be controlled. Furthermore, because the stator assembly and the mover assembly of the drive assembly are connected in a non-contact manner, an air gap existing between the mover assembly and the stator assembly has a certain buffering effect and can reduce vibration during work.

4. The vacuum die casting machine of the present invention does not need to use an intermediate transmission mechanism, can directly realize linear drive and rotation of the pressure chamber, and has a very short starting distance, which makes the structure more compact, and overcomes complex structure, heavy weight, large size and other shortcomings caused by the hydraulic transmission mechanism. For the die casting machine components, it is easy to achieve modularization and is easy to replace and repair, which can greatly reduce maintenance time and improve overall efficiency.

Figure 1:
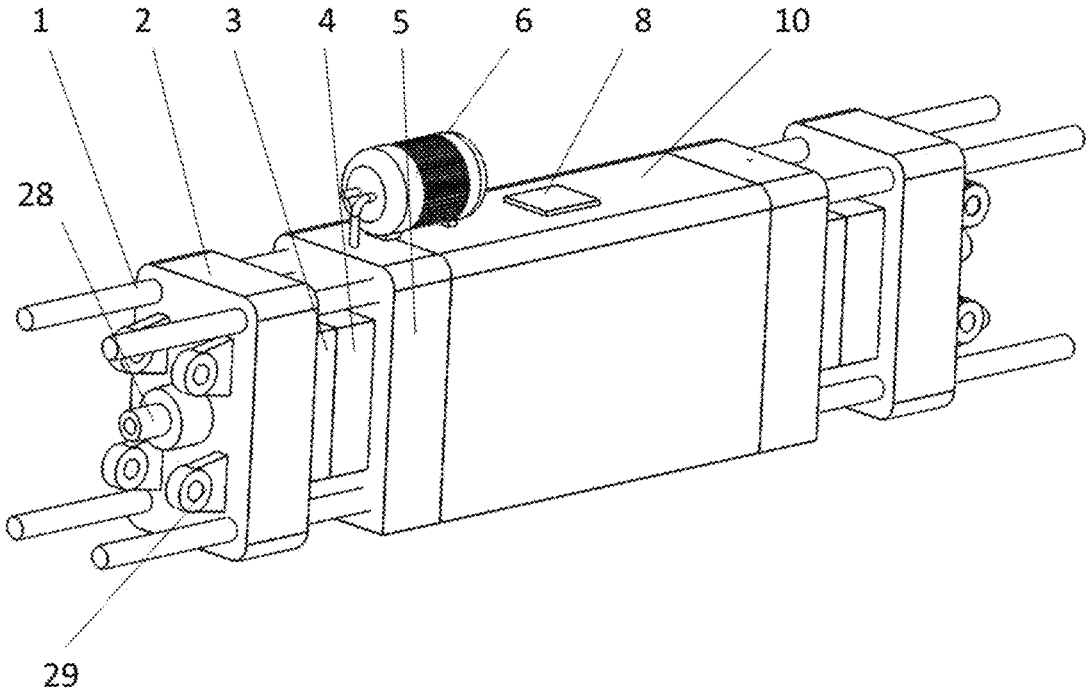
FIG. 1 is a schematic diagram of the three-dimensional structure of the two-way vacuum die casting machine of the present invention.

Among them, the main reference signs are as follows:

sliding rod 1, moving mold plate 2, moving mold 3, fixed mold 4, fixed mold plate 5, vacuum pump 6, supporting rod 7, feeding door 8, electric heating crucible 9, housing 10, rotating device stator iron core 11, rotating device stator winding 12, rotating device installation housing 13, rotating device permanent magnet 14, rotating device rotor sleeve 15, mover permanent magnet 16, drive base 17, stator iron core 18, mover sleeve 19, heat-insulating end cover 20, injection rod 21, molten metal supply port 22, rotating device end cover 23, injection punch 24, pressure chamber 25, pressure chamber sleeve 26, sealing ring 27, ejection cylinder 28, mold clamping mechanism connection hole 29, stator winding 30, molten metal outflow port 31, fixed mold insert block 32, cross runner 33, molten metal pouring port 34, molten metal remnant fixed mold insert block 35, molten metal remnant cross runner 36, molten metal remnant pouring port 37, constant pressure passage connection port 38, sleeve molten metal pouring port 39, sleeve molten metal remnant pouring port 40, sleeve constant pressure passage connection port 41, moving mold insert block 42, molten metal remnant moving mold insert block 43, pressure chamber sleeve mating groove 44, and sliding rod through hole 45.

DETAILED DESCRIPTION

Hereinafter, embodiments of the present invention will be described with reference to the drawings.

Specifically, as shown in FIGS. 1 to 14, the present invention provides a double station vacuum die casting machine, which comprises a driving device, a first die casting unit, a second die casting unit, a feeding component, a vacuum pump 6 and a housing 10. The driving device is arranged inside the housing 10, and the first die casting unit and the second die casting unit are arranged on both sides of the driving device. The vacuum pump is located outside the housing 10.

The driving device comprises a driving unit, a first injection rod assembly and a second injection rod assembly. The first injection rod assembly and the second injection rod assembly are respectively arranged on both sides of the stator assembly. The first injection rod assembly is used to provide power for die casting of the first die casting unit, and the second injection rod assembly is used to provide power for die casting of the second die casting unit.

The drive unit comprises a stator assembly and a mover assembly. The mover assembly is arranged inside the stator assembly. The stator assembly comprises a drive base 17, a stator iron core 18, a stator winding 30 and a stator iron core winding groove. The stator iron core 18 is located in the drive device installation through hole in the drive base 17, the drive base 17 is installed in the middle of the bottom surface of the housing 10. The first end and the second end of the drive device installation through hole in the drive base 17 are provided with heat-insulating end covers 20. The stator winding 30 are located in the stator iron core winding groove in the stator iron core 18.

The mover assembly comprises mover permanent magnets 16 and a mover sleeve 19, and the mover permanent magnets 16 are evenly distributed on the mover sleeve 19. The first injection rod assembly and the second injection rod assembly are symmetrically arranged and both include an injection rod 21 and an injection punch 24. The first end of the injection rod 21 is connected to the injection punch 24, the first end of the mover sleeve 19 is connected to the first injection rod assembly, and the second end of the mover sleeve 19 is connected to the second injection rod assembly.

Figure 2:
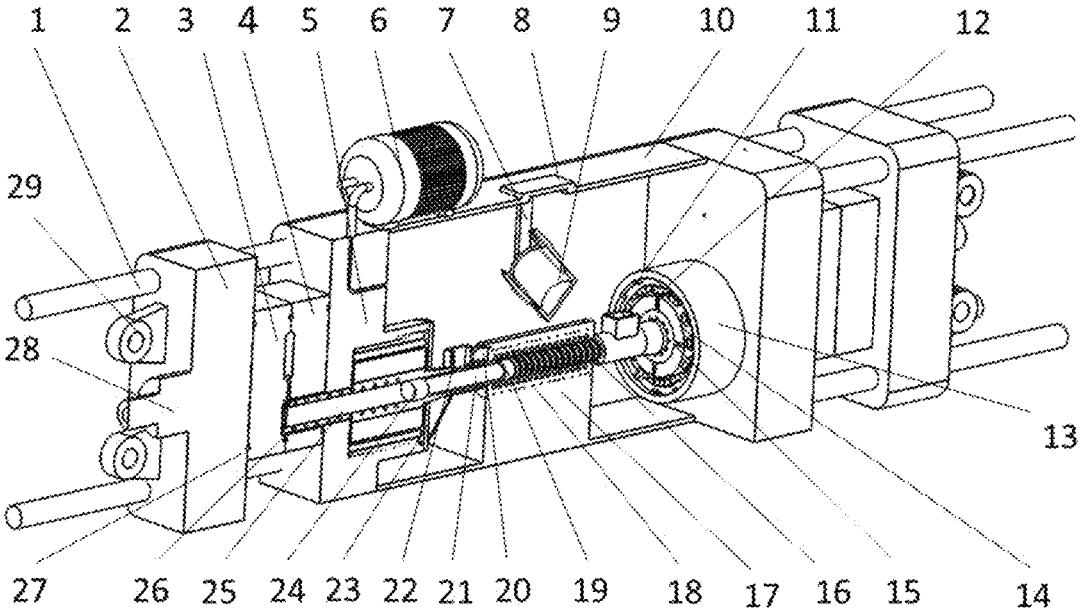
FIG. 2 is a partial structural diagram of the two-way vacuum die casting machine of the present invention.
Figure 3:
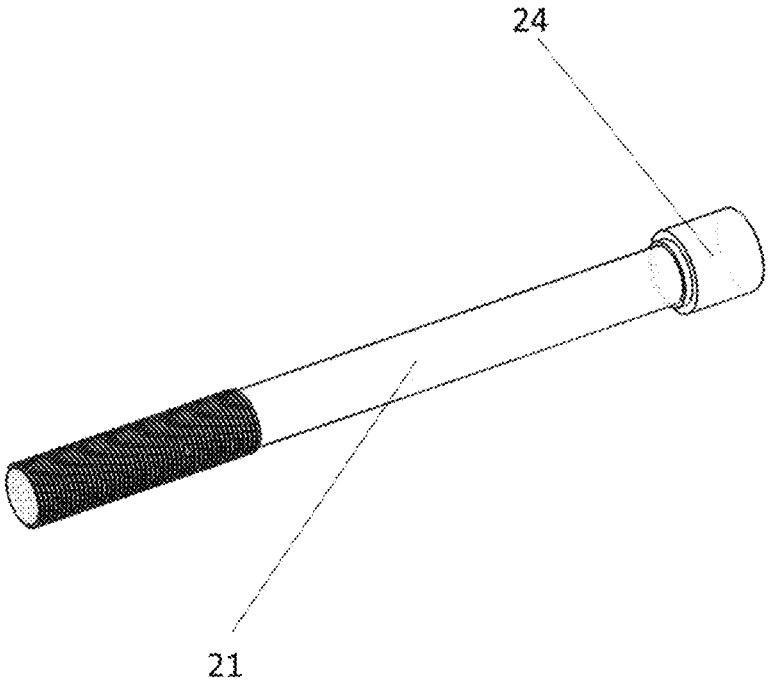
FIG. 3 is a schematic diagram of the injection assembly of the two-way vacuum die casting machine of the present invention.

As shown in FIG. 2, the first die casting unit and the second die casting unit are symmetrically arranged, and the types and shapes of the die casting parts are exactly the same. Both the first die casting unit and the second die casting unit include a rotating device, a fixed mold assembly, a moving mold assembly, a sealing ring 27 and a sliding rod 1.

Taking the first die casting unit as an example, the rotating device comprises a rotating device stator assembly and a rotating device rotor assembly. The rotating device rotor assembly is provided inside the rotating device stator assembly. The rotating device stator assembly comprises a rotating device stator iron core 11 and a rotating device stator winding 12. The rotating device stator iron core 11 is connected to the rotating device stator winding 12. The rotating device stator iron core 11 is installed in the rotating device installation housing 13 at the second end of the fixed mold plate 5; the rotating device rotor assembly comprises the rotating device permanent magnet 14 and the rotating device rotor sleeve 15. The rotating device permanent magnets 14 are evenly and circumferentially distributed outside the rotating device rotor sleeve 15. The rotating device stator assembly is in the rotating device mover assembly. The rotating device rotor sleeve 15 is connected to the pressure chamber 25.

The fixed mold assembly comprises a fixed mold 4, a fixed mold plate 5, a pressure chamber 25, and a pressure chamber sleeve 26. The first end of the fixed mold 4 is provided with a molten metal pouring port 34, a cross runner 33, a fixed mold insert block 32, a molten metal remnant pouring port 37, a molten metal remnant cross runner 36, a molten metal remnant fixed mold insert block 35, a constant pressure passage connection port 38 and a constant pressure passage. The fixed mold insert block 32 is connected to the first end of cross runner 33. The second end of the cross runner 33 is provided with a molten metal pouring port 34. The molten metal remnant fixed mold insert block 35 is connected to the first end of the molten metal remnant cross runner 36. The second end of the molten metal remnant cross runner 36 is connected to the molten metal remnant pouring port 37. The constant pressure passage connection port 38 is connected to the constant pressure passage. The second end of the fixed plate 5 is provided with a rotating device installation housing 13. The first end of the fixed plate 5 is connected to the second end of the fixed mold 4 through a sealing ring 27. The second end of the fixed mold plate 5 is connected to the first end of the housing 10. The pressure chamber 25 is provided with a molten metal supply port 22 and a molten metal outflow port 31. The molten metal outflow port 31 is located at the upper part of the first end of the pressure chamber 25. The molten metal supply port 22 is located at the upper part of the second end of the pressure chamber 25. The pressure chamber 25 is located inside the fixed mold 4, the fixed mold plate 5 and the housing 10. The pressure chamber sleeve 26 is provided outside the pressure chamber 25. The pressure chamber sleeve 26 is provided with a sleeve molten metal pouring port 39, a sleeve molten metal remnant pouring port 40 and a sleeve constant pressure passage connection port 41. The sleeve molten metal pouring port 39 is connected to the molten metal pouring port 34. The sleeve molten metal remnant pouring port 40 is connected to the molten metal remnant pouring port 37. The sleeve constant pressure connection port 41 is connected to the constant pressure passage connection port 38. The pressure chamber sleeve 26 is sleeved outside the pressure chamber 25. The inner corners of fixed mold plate are respectively connected to the sliding rod 1.

The moving mold assembly comprises a moving mold 3, a moving mold plate 2, a mold clamping mechanism connection hole 29, an ejection cylinder 28, a pressure chamber sleeve mating groove 44, a sliding rod through hole 45, a moving mold insert block 42 and a molten metal remnant moving mold insert block 43. The first end of the fixed mold 4 is connected to the second end of the moving mold 3 through a sealing ring 27. The first end of the moving mold 3 is connected to the second end of the moving mold plate 2 through a sealing ring 27. The second end of the moving mold 3 is provided with a pressure chamber sleeve mating groove 44, a sliding rod through hole 45, a moving mold insert block 42 and a molten metal remnant moving mold insert block 43. The first end of the moving mold plate 2 is connected to the ejection cylinder 28. The four inner corners of the first end of the moving mold plate 2 are respectively provided with clamping mechanism connection holes 29. The four inner corners of the moving mold plate 2 are provided with sliding rod through holes 45. The four sliding rods 1 are respectively connected inside the four sliding rod through holes 45.

The feeding components include an electric heating crucible 9, a supporting rod 7 and a feeding door 8. The housing 10 is a completely closed structure. The second end of the fixed mold plate 5 of the first die casting unit is connected to the left end of the housing 10. The first end of the fixed mold plate 5 of the second die casting unit is connected to the right end of the housing 10. The feeding door 8 is located on the upper part of the housing 10. The first end of the supporting rod 7 is connected to the electric heating crucible 9 by a rotating pair. The electric heating crucible 9 is located at the lower end of the feeding door 8. The first end of the supporting rod 7 is located on side of the electric heating crucible 9. The second end of the supporting rod 7 is connected to the lower surface of the top of the housing 10. The vacuum pump 6 is installed on the upper surface of the top end of the fixed mold plate 5 of the first die casting unit.

Figure 5:
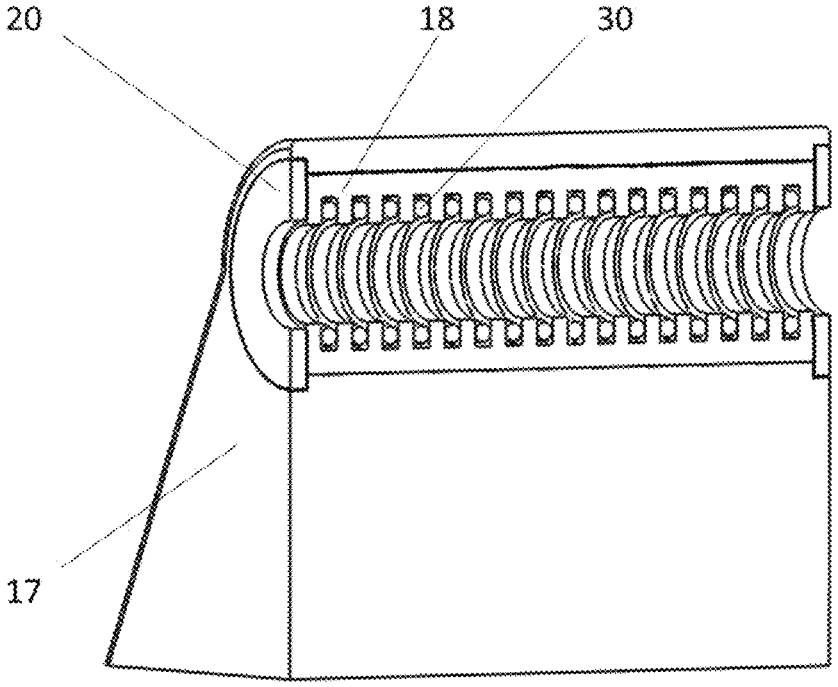
FIG. 5 is a schematic diagram of the stator assembly of the two-way vacuum die casting machine of the present invention.

As shown in FIG. 5, the stator iron core winding grooves are evenly arranged in the stator iron core 18 in an annular shape, stator teeth are formed between the stator iron core winding grooves, and the mover permanent magnets 16 are annular shape. The magnetic poles of the two mover permanent magnets 16 adjacent to each other are opposite. The thickness of the magnetic pole of the mover permanent magnet 16 is the same as the width of the stator teeth.

Figure 4:
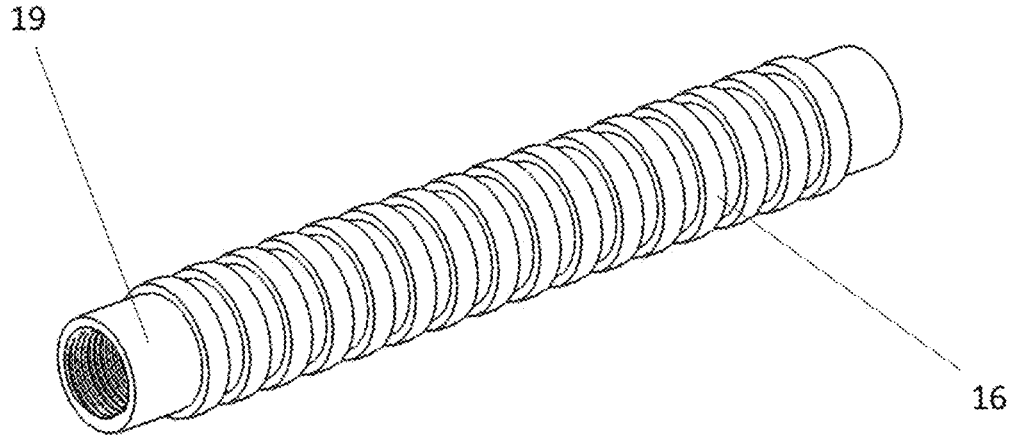
FIG. 4 is a schematic diagram of the mover assembly of the two-way vacuum die casting of the present invention.

As shown in FIG. 4, the mover sleeve 19 is in the shape of a hollow cylinder. The outer surface of the mover sleeve 19 is covered with a good conductive magnet to form a mover yoke. The inner surface of the mover sleeve 19 is provided with internal threads connecting to the threads of an injection rod 21. An air gap is formed between the mover assembly and the stator assembly, which also has a certain buffering effect. The stator winding 30 is wound according to the principle of a cylindrical linear motor to pass a three-phase symmetrical sinusoidal current. Under the interaction between the mover permanent magnet 16 and the traveling wave magnetic field in the mover assembly, an electromagnetic thrust is generated by controlling the three-phase symmetrical sinusoidal currents in the stator winding 30. Since the stator assembly is fixed, the mover sleeve 19 drives the injection assembly to perform a controlled and repeated linear motion under the action of thrust.

Figure 6:
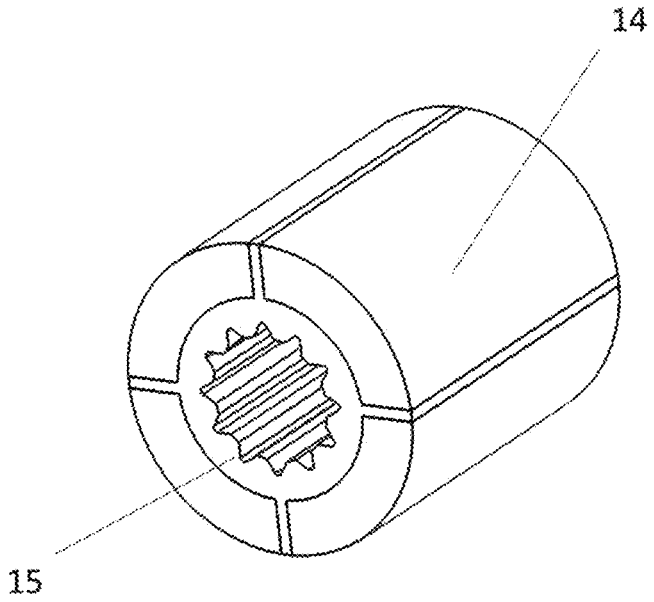
FIG. 6 is a schematic diagram of the rotating device stator assembly of the two-way vacuum die casting machine of the present invention.
Figure 7:
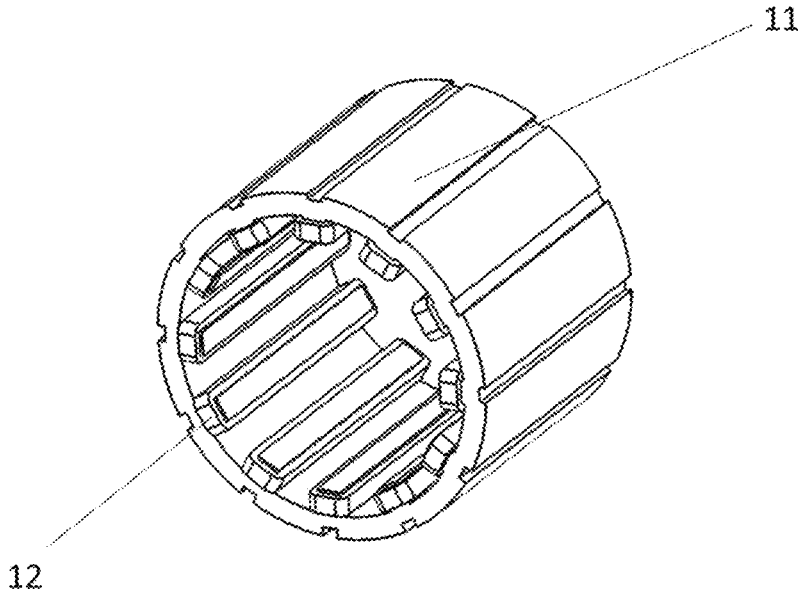
FIG. 7 is a schematic diagram of the rotating device rotor assembly of the two-way vacuum die casting machine of the present invention.

As shown in FIGS. 6 and 7, the inner surface of the rotating device installation housing 13 is circumferentially arranged with a convex structure, and the convex structure has the same shape as the groove structure on the rotating device stator iron core 11, so as to realize the positioning and installation of the stator iron core 11. The rotating device stator iron core 11 is in the shape of a hollow cylinder, and arranges at an interval of 30° the iron core wound with the rotating device stator winding 12. The rotating device stator winding 12 is wound and connected to three-phase sinusoidal alternating current according to the working principle of an asynchronous motor. When three-phase sinusoidal alternating current is applied to the rotating device stator winding 12, a rotating magnetic field is generated that rotates clockwise (or counterclockwise) along the inner circular space of the rotating device stator assembly and the rotating device rotor assembly at a synchronous speed n1. Since the rotating magnetic field rotates at a speed of n1, the conductor of the rotating device rotor assembly is stationary at the beginning, and the rotating device permanent magnet 14 and the rotating device stator assembly make a controllable rotation under the action of the force generated by the rotating magnetic field. The rotating device rotor sleeve 15 is in the shape of a hollow cylinder. The inner surface of the rotating device rotor sleeve 15 is provided with a circumferential tooth-like structure, which has the same shape as the circumferential tooth-like structure of the outer surface of the connecting part of the pressure chamber 25 for mating connection.

Figure 8:
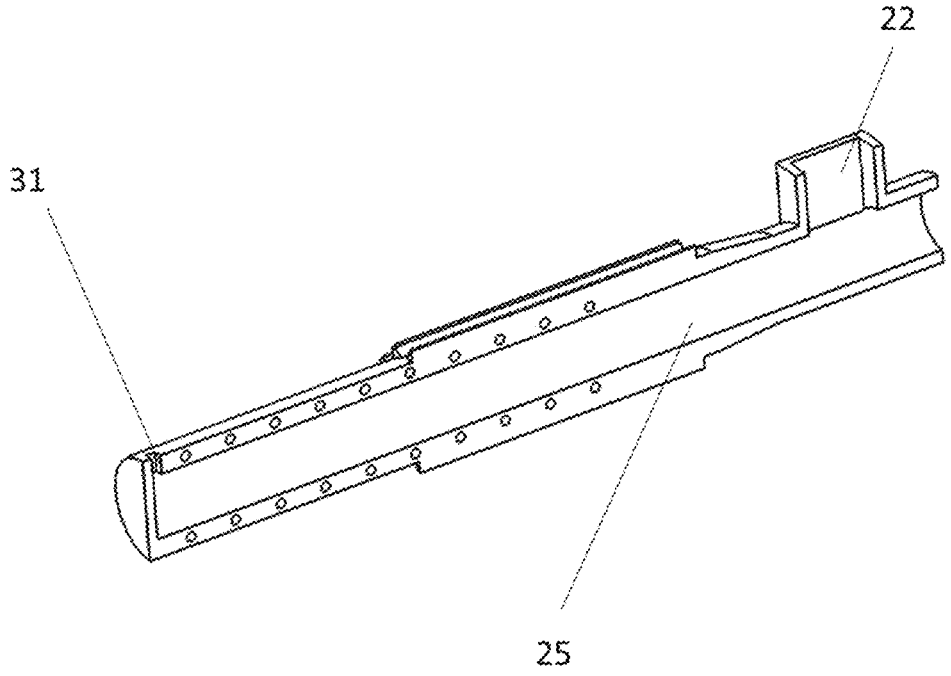
FIG. 8 is a schematic diagram of the pressure chamber of the two-way vacuum die casting machine of the present invention.
Figure 9:
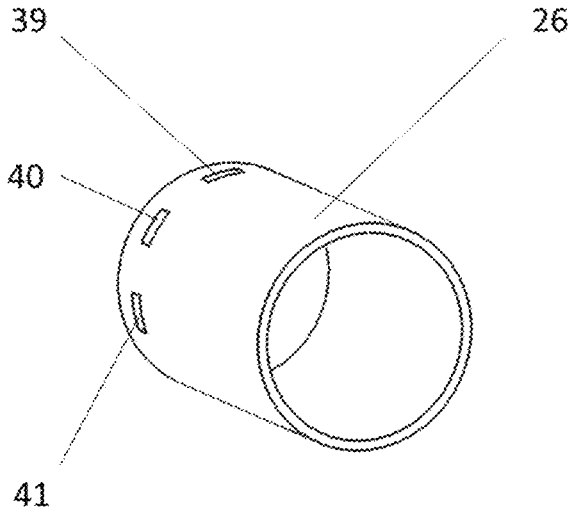
FIG. 9 is a schematic diagram of the pressure chamber sleeve of the two-way vacuum die casting machine of the present invention.
Figure 10:
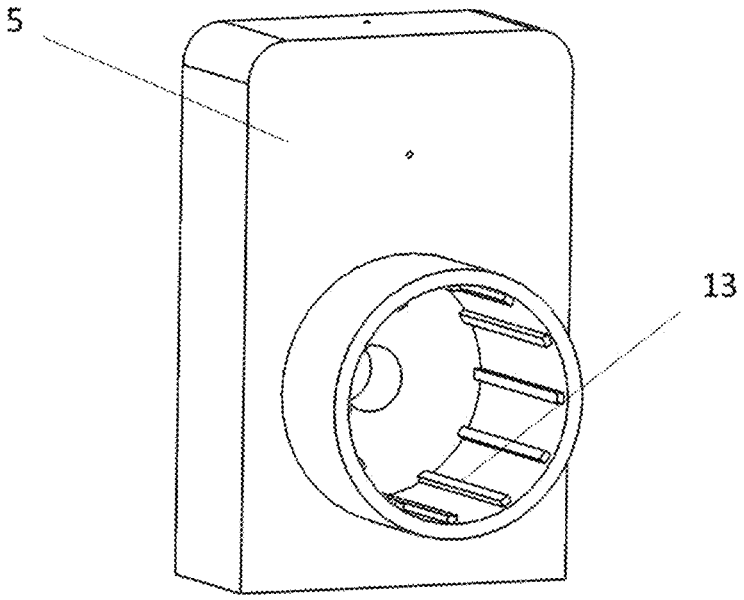
FIG. 10 is a schematic diagram of the moving mold plate structure of the two-way vacuum die casting machine of the present invention.
Figure 11:
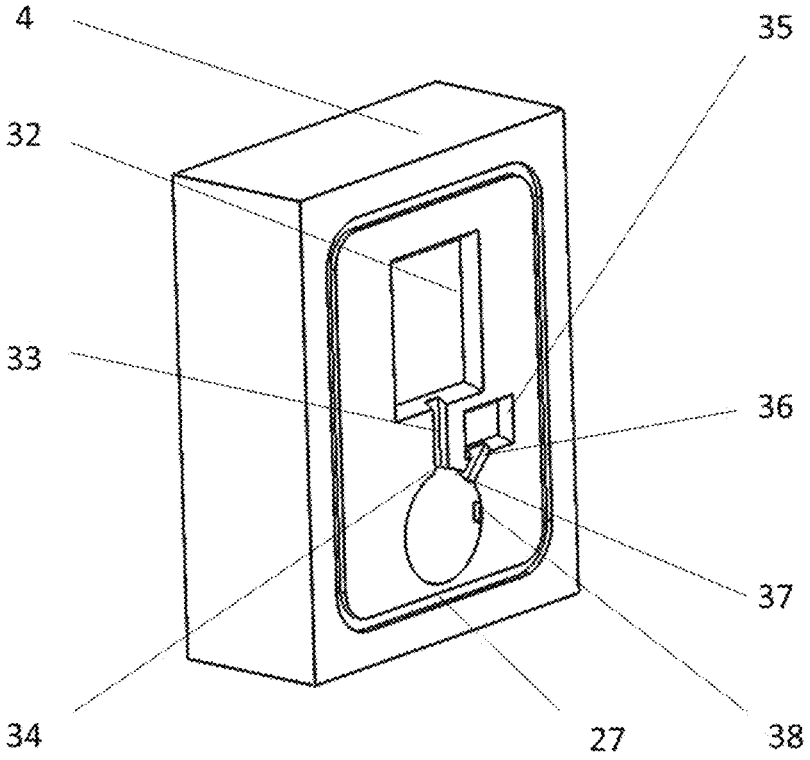
FIG. 11 is a schematic diagram of the moving mold structure of the two-way vacuum die casting machine of the present invention.
Figure 12:
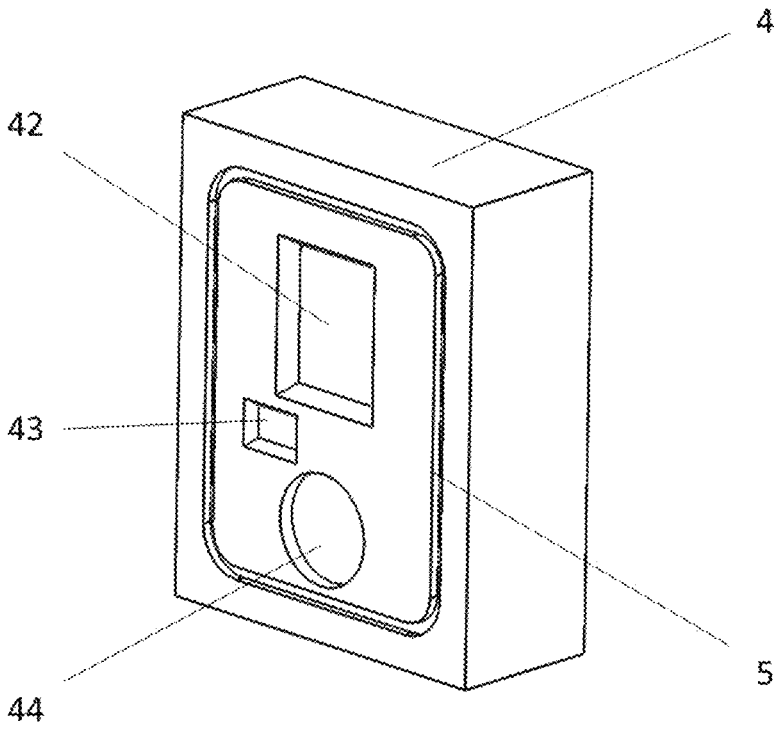
FIG. 12 is a schematic diagram of the fixed mold structure of the two-way vacuum die casting machine of the present invention.
Figure 13:
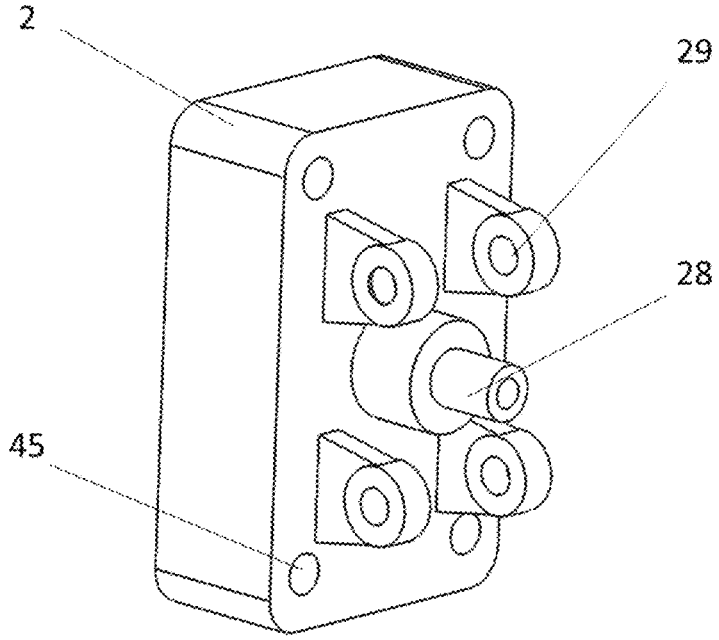
FIG. 13 is a schematic diagram of the fixed mold plate structure of the two-way vacuum die casting machine of the present invention.

As shown in FIGS. 8 and 9, the size and shape of the molten metal outflow port 31 of the pressure chamber 25 are exactly the same as that of the sleeve molten metal pouring port 39, the sleeve molten metal remnant pouring port 40 and the sleeve constant pressure passage connection port 41, to prevent the inconsistency of the shape resulting in partially bonding the molten metal and the pouring port to reduce the service life of the mold. As shown in FIG. 8, the sleeve molten metal pouring port 39 is located at the upper part of the first end of the pressure chamber sleeve 26. The sleeve molten metal remnant pouring port 40 and the sleeve constant pressure passage connection port 41 are on the same circumferential line as the sleeve molten metal pouring port 39 and are arranged at intervals of 45° in sequence. The constant pressure passage connection port 41 is provided with a certain depth to prevent the molten metal from directly interacting with the constant pressure passage connection causing the constant pressure passage to be blocked. As shown in FIG. 11, the constant pressure passage connection port 38 on the fixed mold 4 is connected to the constant pressure passage that passes through the fixed mold 4 and the fixed mold plate 5 and communicates with the vacuum chamber. The inner part of the pressure chamber 25 which is located inside the fixed mold plate 5 and the fixed mold 4 is provided with a heating device to ensure that the molten metal maintains the temperature required for die casting, to ensure that the metal at the molten metal outflow port is easily cut off when the pressure chamber 25 is rotated, and that the molten metal will not be un-solidified and cause the constant pressure passage to be blocked during the return stroke of the remaining molten metal and the injection punch 24 is pressed out.

As shown in FIGS. 2 and 9, an angle sensor is provided on the rotating device end cover 23. The pressure chamber 25 is rotated by the rotating device and has three working positions relative to the pressure chamber sleeve 26: a first position: the molten metal outflow port 31 is opposite to the sleeve molten metal pouring port 39 to realize the mold cavity communication between the fixed mold insert block 32 and the moving mold insert block 42 for die casting of the molten metal; a second position: the molten metal outflow port 31 is opposite to the sleeve molten metal pouring port 40 to realize the discharge of redundant molten metal from the pressure chamber 25; a third position: the molten metal outflow port 31 is opposite to the sleeve constant pressure passage connection port 41 to realize the negative pressure in the balanced pressure chamber 25 so that the injection rod 21 can return.

As shown in FIG. 2, the axes of the pressure chamber 25 of the first die casting unit and the second die casting unit, the injection assembly, the pressure chamber sleeve 26, the stator iron core 18, the heat-insulating end cover 20, the mover permanent magnet 16 and the mover sleeve 19, the rotating device stator iron core 11 and the rotating device rotor sleeve 15 are on the same straight line. The extreme position of the rightward movement of the injection punch 24 is connected to the inside of the second end of the pressure chamber 25 to prevent molten metal in the pressure chamber from flowing out of the second end of the pressure chamber. The axes of the fixed mold plate 5, the fixed mold 4, the moving mold 3, the moving mold plate 2 and the sealing ring 27 are on the same straight line. The inner diameter of the pressure chamber is equal to the diameter of the injection punch. Both of the inner diameter of the pressure chamber 25 and the diameter of the injection punch 24 are larger than the diameter of the injection rod 21.

Figure 14:
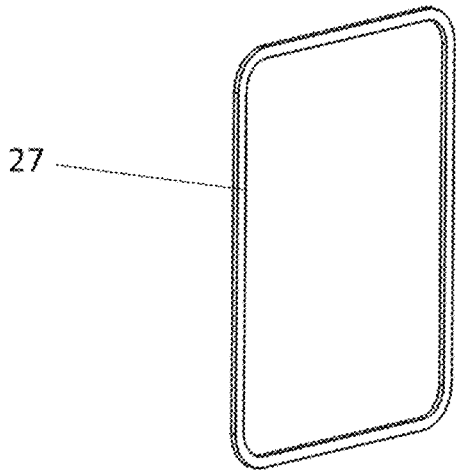
FIG. 14 is a schematic structural diagram of the sealing ring of the two-way vacuum die casting machine of the present invention.

As shown in FIG. 14, the outer shape of the sealing ring 27 is a rectangular frame, the outer frame of the sealing ring 27 is smaller than the connecting surface of the fixed mold 4 and the moving mold 3. The connecting surface of the fixed mold 4 and the moving mold 3 is smaller than that of the fixed mold plate 5 and the moving mold plate 2. Sealing ring grooves are provided on the fixed mold 4 and the moving mold 3. The width of the sealing ring groove is smaller than the thickness of the sealing ring 27. The sealing ring 27 between the moving mold 3 and the fixed mold 4, the sealing ring 27 between the fixed mold 4 and the fixed mold plates 5, and the sealing ring 27 between the moving mold 3 and the moving mold plate 2 play a role of sealing during the die casting of the molten amorphous alloy to ensure the quality of the die casting.

The working principle of a double station vacuum die casting machine of the present invention will be further described below in conjunction with embodiments:

When the device is used to perform amorphous alloy die casting, firstly, taking the first die casting unit to start to work as an example, a mold clamping machine is connected through a left mold clamping mechanism connection hole 29, to drive the moving mold plate 2, the moving mold 3, the fixed mold 4 and the fixed mold plate 5 to be mold clamped, so as to ensure that the vacuum die casting machine is sealed during the vacuuming process. Due to the special property of the amorphous alloy, in order to reduce the waste of the molten amorphous alloy caused by contacting with the air and obtain the pure molten amorphous alloy as much as possible, an appropriate amount of bulk amorphous alloy is put in each die casting.

Then, the bulk amorphous alloy is put into the electric heating crucible 9 through the feeding door 8, and the vacuum pump 6 is started to vacuum the inside of the die casting machine until the inside of the die casting machine reaches a predetermined vacuum value. And then, the electric heating crucible 9 is energized and heated such that the amorphous alloy in the electric heating crucible 9 is heated to obtain a molten amorphous alloy liquid. In this way, not only qualified amorphous alloy liquid is obtained, but also waste of amorphous alloy is prevented. After the electric heating crucible 9 heats the amorphous alloy to obtain the molten amorphous alloy liquid, a pouring mechanism on the crucible supporting rod 7 rotates around the rotating pair connected to the electric heating crucible 9 to pour the molten amorphous alloy liquid into the pressure chamber 25 through the molten metal supply port 22. The pressure chamber heating device works to keep the molten metal within the appropriate die casting temperature range, and because the power source of the device is provided by the stator assembly and the mover assembly of the drive device, the three-phase symmetrical sinusoidal alternating current passing through the stator windings is controlled to make the injection punch 24 to have extremely fast speed and great force when the injection rod 21 drives the injection punch 24 to move toward left side, which can prevent the rapid cooling of the metal solution in the pressure chamber 25 resulting in adherence to the inner wall of the pressure chamber 25, therefore, the waste of amorphous alloys is reduced and the service life of the pressure chamber is increased. At this time, the rotating device is in the first position. The molten metal outflow port 31 is connected to the molten metal pouring port 34, and the molten amorphous alloy liquid in the pressure chamber 25 is quickly pushed into the molten metal pouring port 34 of the fixed mold 4. At this time, the molten amorphous alloy is pressed to enter from the molten metal pouring port 34 of the fixed mold 4 to the cross runner 33 connected thereto, and finally is transported to the mold cavity between the fixed mold insert block 32 and the moving mold insert block 42, wherein it is rapidly cooled and solidified into a die casting part. The injection punch 24 remains the station of holding pressure toward the left side. At this time, the right end of the die casting part starts to work. When the electric heating crucible 9 rotates around the rotating pair connected to the supporting rod 7 through the pouring mechanism on the supporting rod 7, the molten amorphous alloy liquid is poured into the pressure chamber 25 through the molten metal supply port 22 of the second die casting unit.

At the same time, during the process, the heating devices of the pressure chamber 25 of the first die casting unit and the second die casting unit have been kept in working condition, so that the molten metal in the molten metal outflow port 31 of the first die casting unit has not yet been solidified, and the molten metal in the pressure chamber 25 of the second die casting unit has been maintained at a suitable die casting temperature. At this time, the rotation of the rotating device drives the pressure chamber 25 to rotate to the second position. The pressure chamber 25 and the pressure chamber sleeve 26 rotate relative to each other to cut off the molten metal from the molten metal pouring port. The molten metal outflow port 31 communicates with the sleeve molten metal pouring port 39. The injection rod 21 drives the injection punch 24 connected to it to continue to move toward the left side, pressing the molten metal remnant to the mold cavity between the molten metal remnant fixed mold insert block 35 and the molten metal remnant moving mold insert block 43. When the injection punch 24 contacts the inner surface of the first end of the pressure chamber 25, the molten metal remnant in the pressure chamber 25 is completely discharged, and the rotating device continue to drive the pressure chamber 25 to rotate to make the pressure chamber 25 rotate to the third position. The molten metal outflow port 31 is connected to the working chamber through a constant pressure passage. The negative pressure in the pressure chamber 25 is balanced, and the injection rod 21 drives the injection punch 24 connected to it to move toward the right side to start the die casting work of the second die casting unit. After the die casting of the die casting part of the first die casting unit is completed, the mold clamping mechanism connected to the right side of the mold clamping mechanism connection hole 29 moves so that the moving mold plate 2 drives the moving mold 3 to move through the sliding rod 1, and at the same time, the moving mold 3 and the fixed mold 4 are separated to act the mold opening movement. The die casting part that has been die-casted is pushed out under the action of the ejection cylinder 28 connected to the moving mold plate 2, and the die casting part is taken out.

Finally, the mold clamping mechanism connected through the mold clamping mechanism connection hole 29 on the right side of the vacuum die casting machine performs an opposite movement, so that the moving mold plate 2 drives the moving mold 3 to move in the opposite direction until the moving mold 3 and the fixed mold 4 are mold clamped. After that, the movement is stopped, and the mold cavity of the vacuum die casting machine is maintained in a vacuum state again. At this time, the second die casting unit completes die casting, mold opening, parts taking out, and mold clamping which are the same as that of the first die casting unit.

The above-mentioned embodiments only describe the preferred embodiments of the present invention, and do not limit the scope of the present invention. Without departing from the design spirit of the present invention, the skilled in the art have made various contributions to the technical solutions of the present invention. Such modifications and improvements should fall within the scope of protection determined by the claims of the present invention.

What is claimed is:

1. A double station vacuum die casting machine, wherein it comprises a driving device, a first die casting unit, a second die casting unit, a feeding component, a vacuum pump and a housing, the vacuum pump is arranged outside the housing, the driving device is arranged inside the housing, and the first die casting unit and the second die casting unit are respectively arranged on both sides of the driving device;

the driving device comprises a driving unit, a first injection rod assembly and a second injection rod assembly, the first injection rod assembly and the second injection rod assembly are respectively arranged on both sides of the driving unit, the first injection rod assembly is used to provide power for die casting of the first die casting unit, and the second injection rod assembly is used to provide power for the second die casting unit;

the driving unit comprises a stator assembly and a mover assembly, the mover assembly is arranged inside the stator assembly, the stator assembly comprises a drive base, a stator iron core, a stator winding, and a stator iron core winding groove, the stator iron core is installed inside the drive base, the drive base is installed in a middle of a bottom surface of the housing, the stator iron core winding groove is arranged inside the stator iron core, the stator winding is installed inside the stator iron core winding groove; the mover assembly comprises a mover permanent magnet and a mover sleeve, the mover permanent magnet is evenly distributed on the mover sleeve; the first injection rod assembly and the second injection rod assembly are symmetrically arranged, the first end of the mover sleeve is connected to the first injection rod assembly, and the second end of the mover sleeve is connected to the second injection rod assembly;

the first die casting unit and the second die casting unit are symmetrically arranged and have the same structure, both of the first die casting unit and the second die casting unit include a rotating device, a fixed mold assembly, a moving mold assembly, and a sliding rod;

the fixed mold assembly comprises a fixed mold, a fixed mold plate, a pressure chamber, and a pressure chamber sleeve, the first end of the fixed mold is provided with a molten metal pouring port, a cross runner, a fixed mold insert block, a molten metal remnant pouring port, a molten metal remnant cross runner, a remnant fixed mold insert block, a constant pressure passage connection port and a constant pressure passage, the fixed mold insert block is connected to the first end of the cross runner, and the second end of the cross runner is provided with a molten metal pouring port, the remnant fixed mold insert block is connected to the first end of the molten metal remnant cross runner, the second end of the molten metal remnant cross runner is provided with a molten metal remnant pouring port, the constant pressure passage connection port is connected to the constant pressure passage, the first end of the fixed mold plate is connected to the first end of the fixed mold, an inner corner of the fixed mold plate is connected to the sliding rod, the second end of the fixed mold plate is connected to the first end of the housing, and the pressure chamber is connected to the rotating device;

the moving mold assembly comprises a moving mold, a moving mold plate, an ejection cylinder, a sliding rod through hole, a moving mold insert block and a molten metal remnant moving mold insert block, the first end of the moving mold plate is connected to the second end of the moving mold, the first end of the moving mold is connected to the second end of the fixed mold, the second end of the moving mold is provided with a moving mold insert block and a molten metal remnant moving mold insert block, the second end of the moving mold plate is connected to the ejection cylinder, and an inner corner of the moving mold plate is connected to a sliding rod;

the pressure chamber is located inside the fixed mold plate, the fixed mold and the housing, the pressure chamber sleeve is arranged outside the first end of the pressure chamber, the first end of the pressure chamber is connected to the second end of the moving mold by means of the pressure chamber sleeve, and one end of the first injection rod assembly extends into the second end of the pressure chamber;

the pressure chamber is provided with a molten metal supply port and a molten metal outflow port, the molten metal outflow port is located at the upper part of the first end of the pressure chamber, the molten metal supply port is located at the upper part of the second end of the pressure chamber, the pressure chamber sleeve is provided with a sleeve molten metal pouring port, a sleeve molten metal remnant pouring port and a sleeve constant pressure passage connection port, the sleeve molten metal pouring port is connected to the molten metal pouring port, the sleeve molten metal remnant pouring port is connected to the molten metal remnant pouring port, and the constant pressure passage connection port is connected to the sleeve constant pressure passage connection port;

the pressure chamber has three positions relative to the pressure chamber sleeve by means of rotation of the rotating device:

a first position: the pressure chamber molten metal outflow port is opposite to the sleeve molten metal pouring port;

a second position: the pressure chamber molten metal outflow port is opposite to the sleeve molten metal remnant pouring port;

a third position: the pressure chamber molten metal outflow port is opposite to the constant pressure passage connection port.

2. The double station vacuum die casting machine according to claim 1, wherein the stator iron core winding grooves are evenly arranged in the stator iron core in an annular shape, stator teeth are formed between the stator iron core winding grooves, the mover permanent magnets are in annular shape, the magnetic poles of two adjacent mover permanent magnets are opposite, and the thickness of the magnetic pole of the mover permanent magnets is the same as the width of the stator teeth;

the mover sleeve is in the shape of a hollow cylinder, the outer surface of the mover sleeve is covered with a conductive magnet to form a mover yoke, and the inner surface of the mover sleeve is provided with internal threads connecting to threads of the injection rod, a gap between the mover assembly and the stator assembly forms an air gap;

the drive base is provided with a drive device installation through hole for installing the stator iron core, and the first end and the second end of the drive device installation through hole are respectively provided with heat-insulating end covers.

3. The double station vacuum die casting machine according to claim 1, wherein the feeding component comprises an electric heating crucible, a supporting rod and a feeding door, the second end of the fixed mold plate of the first die casting unit is connected to the first end of the housing, the first end of the fixed mold plate of the second die casting unit is connected to the second end of the housing, the feeding door is located at the upper part of the housing, the first end of the supporting rod is connected to the side of the electric heating crucible through a rotating pair, the electric heating crucible is located at the lower end of the feeding door, the second end of the supporting rod is fixedly connected to the housing at the feeding door; the vacuum pump is located at the upper end of the fixed mold plate of one of the die casting units.

4. The double station vacuum die casting machine according to claim 1, wherein the rotating device comprises a rotating device stator assembly and a rotating device rotor assembly, the rotating device rotor assembly is provided inside the rotating device stator assembly, the rotating device stator assembly comprises a rotating device stator iron core and a rotating device stator winding connected to each other; the rotating device rotor assembly comprises rotating device permanent magnets and a rotating device rotor sleeve, and the rotating device permanent magnets are evenly arranged on the circumference of the rotating device rotor sleeve.

5. The double station vacuum die casting machine according to claim 1, wherein the second end of the moving mold is provided with a pressure chamber sleeve mating groove that is mated with the pressure chamber sleeve, and four inner corners of the moving mold plate are provided with sliding rod through holes for connecting the sliding rod;

the second end of the fixed mold plate is provided with a rotating device installation groove, the rotating device stator iron core is installed in the rotating device installation groove of the second end of the fixed mold plate, and the four inner corners of the first end of the moving mold plate are respectively provided with mold clamping mechanism connection holes.

* * * * *